US009693602B2

(12) United States Patent
Trautmann

(10) Patent No.: US 9,693,602 B2
(45) Date of Patent: Jul. 4, 2017

(54) HIGH HEEL FOOT WEAR PAD AND METHODS OF MAKING AND ATTACHING SAME

(71) Applicant: OrthoSole LTD, Guernsey, Channel Islands (GB)

(72) Inventor: Martin Trautmann, Munich (DE)

(73) Assignee: ORTHOSOLE LIMITED, A GUERNSEY LIMITED COMPANY, Saint Peter Port (Channel Islands) (GG)

( * ) Notice: Subject to any disclaimer, the term of this patent is extended or adjusted under 35 U.S.C. 154(b) by 704 days.

(21) Appl. No.: 13/975,200

(22) Filed: Aug. 23, 2013

(65) Prior Publication Data

US 2014/0053428 A1 Feb. 27, 2014

Related U.S. Application Data

(60) Provisional application No. 61/693,533, filed on Aug. 27, 2012.

(51) Int. Cl.

| | |
|---|---|
| ***A43B 13/38*** | (2006.01) |
| ***A43B 1/00*** | (2006.01) |
| ***A43B 7/14*** | (2006.01) |
| ***A43B 17/18*** | (2006.01) |

(52) U.S. Cl.

CPC ..... *A43B 13/38* (2013.01); *A43B 1/0081* (2013.01); *A43B 7/142* (2013.01); *A43B 7/143* (2013.01); *A43B 7/1465* (2013.01); *A43B 17/18* (2013.01)

(58) Field of Classification Search

CPC ... A43B 7/1425; A43B 7/1145; A43B 7/1435; A43B 7/142; A43B 7/143; A43B 7/1465

See application file for complete search history.

(56) References Cited

U.S. PATENT DOCUMENTS

| | | | | |
|---|---|---|---|---|
| 2,311,925 A * | 2/1943 | Boos | A43B 7/142 36/163 |
| 3,470,880 A | 10/1969 | Pagliano | |
| 4,316,333 A * | 2/1982 | Rothschild | A43B 7/142 36/50.1 |
| 4,694,590 A * | 9/1987 | Greenawalt | A43B 7/1415 36/163 |
| 4,841,648 A * | 6/1989 | Shaffer | A43B 7/1465 36/145 |
| 5,164,878 A | 11/1992 | Hauser | |

(Continued)

FOREIGN PATENT DOCUMENTS

| | | |
|---|---|---|
| DE | 202005011497 U1 | 10/2005 |
| DE | 102008007517 A1 | 8/2009 |

(Continued)

*Primary Examiner* — Ted Kavanaugh

(74) *Attorney, Agent, or Firm* — Jonathan L. Pettit, Esq.; Duckor Spradling Metzger & Wynne

(57) ABSTRACT

Methods and high heel foot wear pads help provide arch support and may include a soft pliable foot engageable sheet for fitting into a high heel foot wear to engage the downwardly sloping arch engageable portion of its inner sole. A fastener on the underside of the sheet is adapted to secure the pad in place on the sloping arch engaging inner sole of the high heel foot wear. An arch support component may be mounted to the underside of the sheet spaced from the edges of the sheet to help support the foot of the wearer.

10 Claims, 9 Drawing Sheets

(56) References Cited

U.S. PATENT DOCUMENTS

| | | | | |
|---|---|---|---|---|
| 2004/0194344 | A1* | 10/2004 | Tadin | A43B 7/141 36/44 |
| 2004/0211086 | A1 | 10/2004 | Dananberg | |
| 2009/0049712 | A1* | 2/2009 | Steszyn | A43B 7/142 36/91 |
| 2012/0246971 | A1* | 10/2012 | Donzis | A43B 7/1425 36/43 |

FOREIGN PATENT DOCUMENTS

| | | | | | |
|---|---|---|---|---|---|
| FR | 702695 | A | * | 4/1931 | A43B 7/14 |
| FR | 1380977 | A | * | 12/1964 | A43B 7/142 |
| GB | 462740 | | | 3/1937 | |
| JP | H03-118003 | | | 12/1991 | |
| WO | 2006108660 | A1 | | 10/2006 | |
| WO | 2007021328 | | | 2/2007 | |

* cited by examiner

HIGH HEEL FOOT WEAR PAD AND METHODS OF MAKING AND ATTACHING SAME

RELATED APPLICATION

This application claims priority to U.S. provisional patent application, entitled HIGH HEEL FOOT WEAR PAD AND METHODS OF MAKING AND ATTACHING SAME, Application No. 61/693,533 filed Aug. 27, 2012.

FIELD OF THE INVENTION

The present invention relates to a high heel foot wear pad and methods of making and attaching it. It more particularly relates to such a pad that may be adjustably or removably positioned in a high heel foot wear such as a woman's high heel shoe or boot.

BACKGROUND ART

This section describes the background art of the disclosed embodiment of the present invention. There is no intention, either express or implied, that the background art discussed in this section legally constitutes prior art.

High heel foot wear such as shoes, boots, sandals or others can be uncomfortable to wear for long periods of time. This is particularly true and even more pronounced for progressively higher heels employed with the foot wear. The foot becomes fatigued due to the awkward positioning of the foot.

Heel cushions or pads have been employed on the interior of shoes or boots at the heel to help absorb shocks to the heel portion of the foot. However, such techniques have not been entirely successful, or satisfactory, in relieving the overall discomfort and fatigue problems when employed with high heel foot wear. Such heel pads have not been successful in providing a comfortable over all experience comparable to the experience achieved with a conventional foot wear such as low heel shoes or boots. The term "footwear" as used herein shall mean and refer to as shoes, boots, sandals, slippers and other wearing apparel adapted to be worn on the foot of the wearer.

BRIEF DESCRIPTION OF THE DRAWINGS

In order to better understand the invention and to see how the same may be carried out in practice, non-limiting preferred embodiments of the invention will now be described with reference to the accompanying drawings, in which.

DETAILED DESCRIPTION OF CERTAIN EMBODIMENTS

Figure 1:
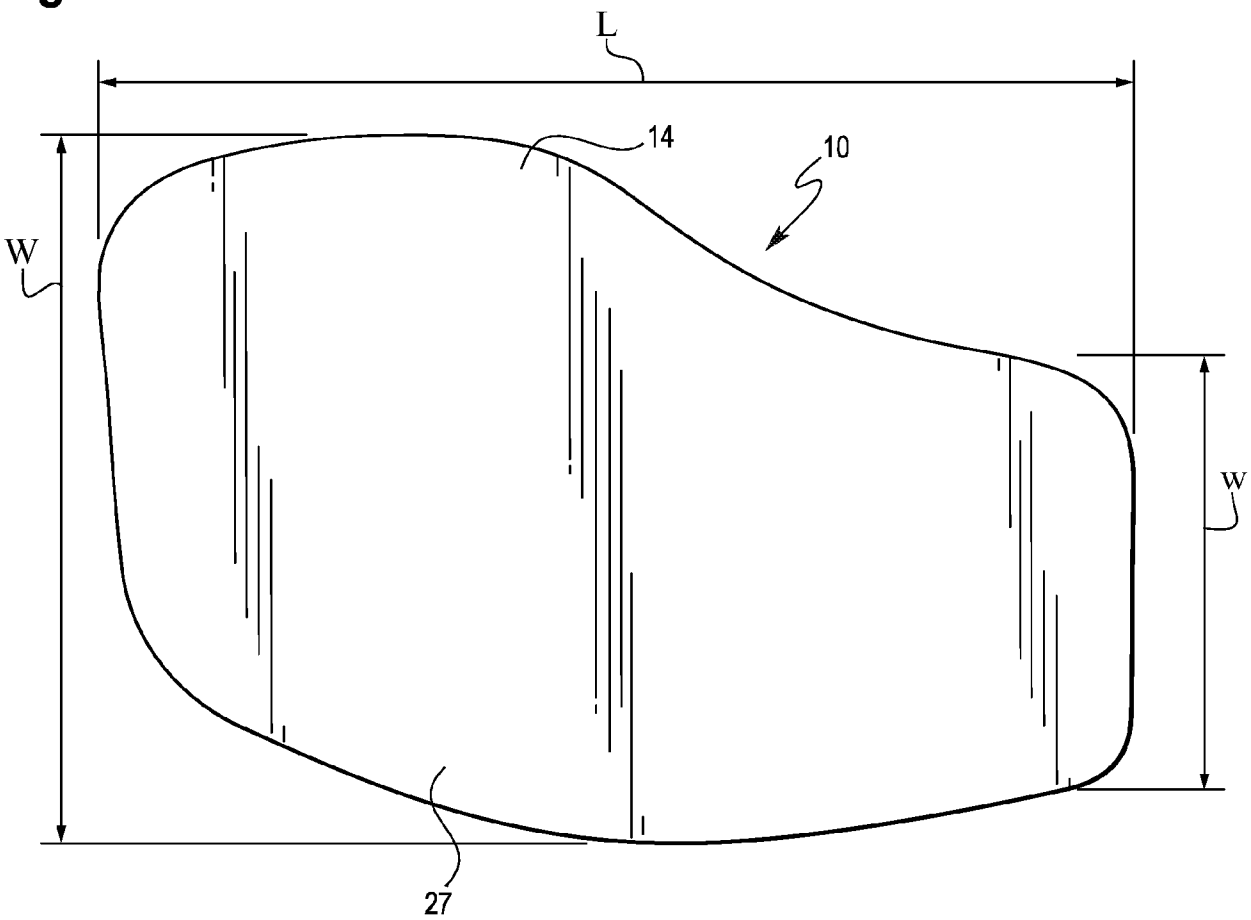
FIG. 1 is a top view of a high heel foot wear pad constructed according to an embodiment.
Figure 2:
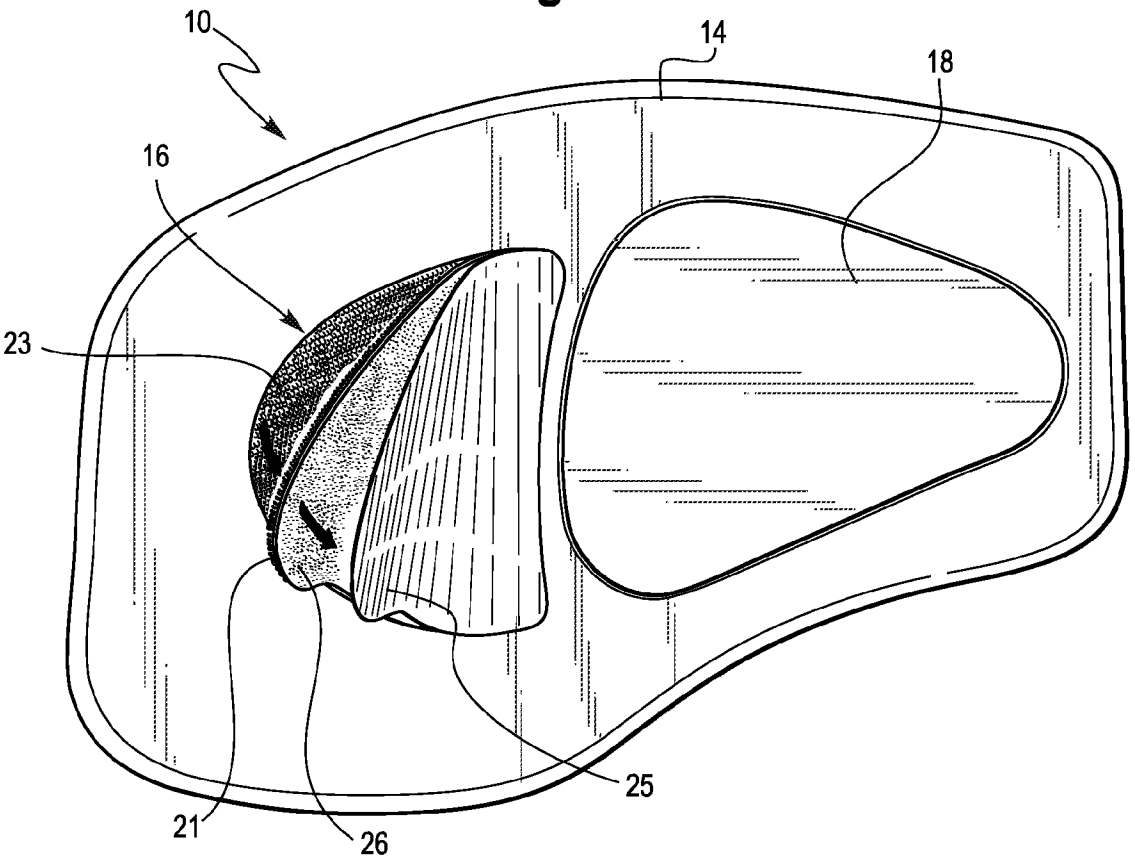
FIG. 2 is a bottom view of the pad of FIG. 1 illustrating a protective cover sheet and a one part of a two-part fastener partially removed.
Figure 3:
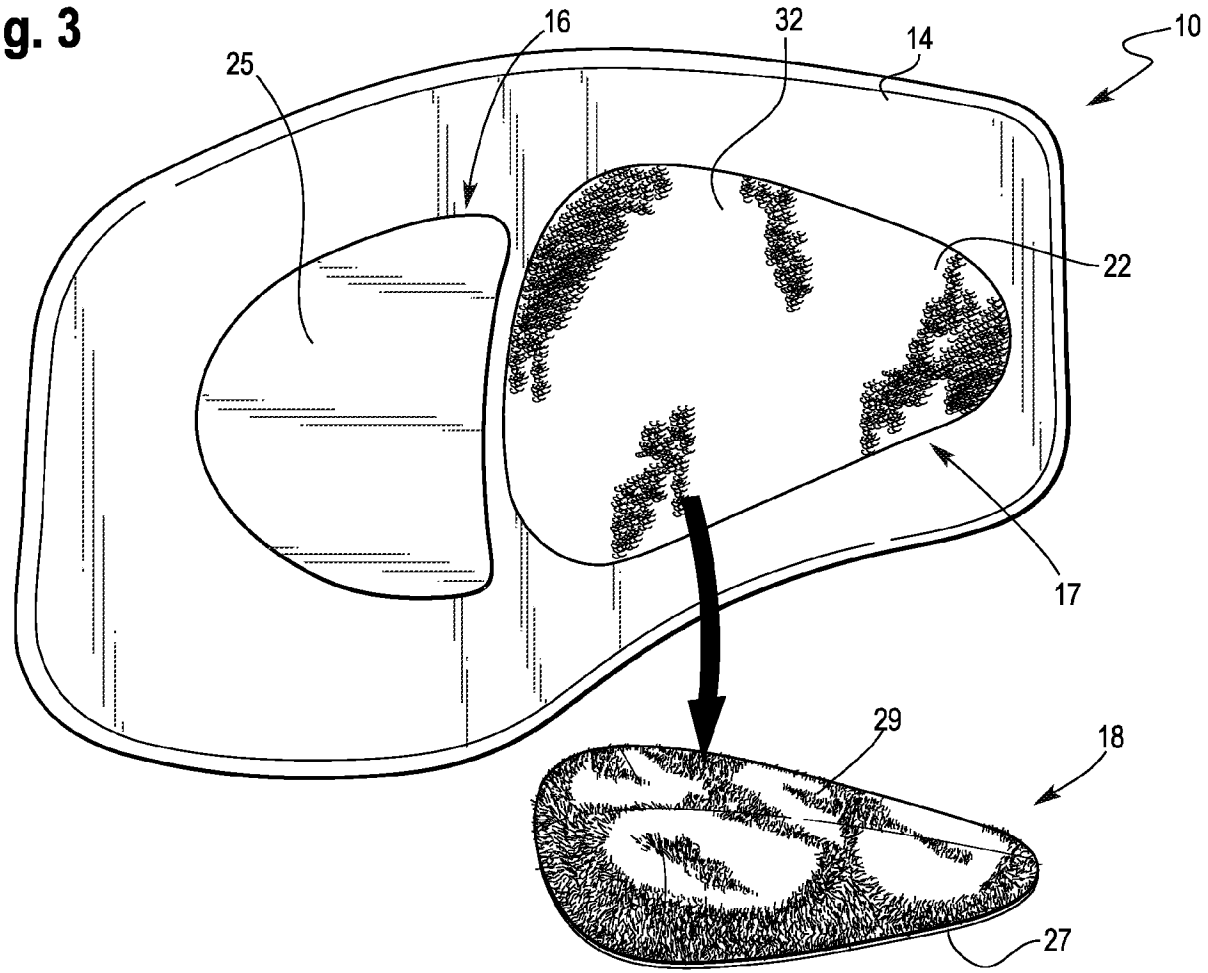
FIG. 3 is a view of the pad of FIG. 1, illustrating the removal of an arch support component thereof.

It will be readily understood that the components of the embodiments as generally described and illustrated in the drawings herein, could be arranged and designed in a wide variety of different configurations. Thus, the following more detailed description of certain ones of the embodiments of the system, components and method of the present invention, as represented in the drawings, is not intended to limit the scope of the invention, as claimed, but is merely representative of the embodiment of the invention.

Methods and high heel foot wear pads help provide arch support and may include a soft pliable foot engageable sheet for fitting into a high heel foot wear to engage the downwardly sloping arch engageable portion of its inner sole. A fastener on the underside of the sheet is adapted to secure the pad in place on the sloping arch engaging inner sole of the high heel foot wear. An arch support component may be mounted to the underside of the sheet spaced from the edges of the sheet to help support the foot of the wearer.

High heel foot wear pads for high heel foot wear, together with methods of making it and using it, are disclosed. An embodiment of a high heel foot wear pad may include a soft pliable foot engageable sheet or shell for fitting into the high heel foot wear to engage its inner sole. A fastener on the underside of the sheet secures the pad in place on the arch engaging inner sole of the high heel foot wear. An arch support component may be mounted to the underside of the sheet and spaced away from the edges of the sheet to help support the foot of the wearer. The pad may have an overall length L and an overall width W, where L is equal approximately to between about 0.95 and about 1.3 times W.

The fastener may include first and second parts where the first part may be attached to the inner sole. The second part may be attached to the sheet underside and releaseably attached to the first part, whereby the positioning of the sheet to the inner sole may be adjusted. The first part may be composed of a fuzzy material and the second part may be composed of hook material. The arch support component may be detachably mounted to the underside of the sheet and spaced away from the edges of the sheet. The pad may include a second arch support component having a thickness different from the first arch support component and may be detachably mounted to the underside of the sheet and spaced away from the edges of the sheet.

The pad may include an enlarged end portion and a narrow end portion. The narrow end portion may include an overall width w, where L is equal approximately to between about 1.9 and about 3.00 times w, and W is equal approximately to between about 1.5 and about 2.5 times w. The arch support component may be generally in the shape of and approximates the shape of an isosceles triangle having three edges including a generally curvilinear short edge integrally connected to a first rounded corner, the first rounded corner integrally integrally connected to a first generally rectilinear side edge having a second rounded corner, the second rounded corner integrally connected to a second generally rectilinear side edge having a third rounded corner, and the third rounded corner integrally connected to the generally curvilinear short edge.

An embodiment of the high heel foot wear pad for high heel foot wear may include an arch support component for fitting into the high heel foot wear to engage the arch engaging inner sole of the high heel foot wear and spaced away from the edges of the inner sole to help support the foot of the wearer. A fastener on the underside of the arch support component may secure the arch support component in place on the inner sole of the high heel foot wear. The arch support component may be generally rounded triangular in shape and may include two longer generally rectilinear side edges.

The fastener on the underside of the arch support component may adjustably secure the arch support component in place on the inner sole of the high heel foot wear. The pad may further include a soft pliable foot engageable sheet for fitting into the high heel foot wear to engage its inner sole. The arch support component may be integral to the underside of the sheet and spaced away from the edges of the sheet to help support the foot of the wearer. The fastener may include first and second parts. The first part may attach to the inner sole and the second part may attach to the sheet underside and be releaseably attachable to the first part such that the positioning of the arch support component to the inner sole may be adjusted. The first part may be composed of a fuzzy material and the second part may be composed of hook material.

The pad may further include a second arch support component having a thickness different from the first arch support component and that is detachably mounted to the underside of the sheet and spaced away from the edges of the sheet. The pad may include an overall length L and an overall width W such that L is equal approximately to between about 0.95 and about 1.3 times W. The pad may include an enlarged end portion and a narrow end portion. The narrow end portion may include a width w such that L is equal approximately to between about 1.9 and about 3.0 times w, and W is equal approximately to between about 1.5 and about 2.5 times w. The arch support component may be generally in the shape of an isosceles triangle having three edges including a generally curvilinear short edge integrally connected to a first rounded corner, the first rounded corner integrally connected to a first generally rectilinear side edge having a second rounded corner, the second rounded corner integrally connected to a second generally rectilinear side edge having a third rounded corner, and the third rounded corner integrally connected to the generally curvilinear short edge.

An embodiment of making a pad for high heel foot wear may include attaching a releasable fastener to the underside of a soft pliable foot engageable sheet to enable the pad to be re-positioned within the foot wear. An arch support component may be attached on the underside of the sheet to help support the foot of the wearer.

The pad may include an overall length L and an overall width W such that L is equal approximately to between about 0.95 and about 1.3 times W. The pad may include an enlarged end portion and a narrow end portion. The narrow end portion may include a width w such that L is equal approximately to between about 1.9 and about 3.0 times w, and W is equal approximately to between about 1.5 and about 2.5 times w. The arch support component may be generally in the shape of and approximates the shape of an isosceles triangle having three edges including a generally curvilinear short edge integrally connected to a first rounded corner, the first rounded corner integrally connected to a first generally rectilinear side edge having a second rounded corner, the second rounded corner integrally connected to a second generally rectilinear side edge having a third rounded corner, and the third rounded corner integrally connected to the generally curvilinear short edge.

An embodiment of attaching a pad to high heal foot wear may including providing a pad having an arch support component attached to the underside of a soft pliable foot engageable sheet. The method may attach fixedly one part of a two-part fastener to an arch engageable inner sole of the high heel foot wear. The method may attach releaseably a second part of the two-part fastener to the underside of the sheet for engaging releaseably the first part to fix releaseably the arch support component in a position to help support the arch of the wearer.

The second part of the fastener may be detached from the first part thereof to facilitate the repositioning of the arch support component to another position for more effectively enabling the arch support component to support the arch of the wearer. The pad may include an overall length L and an overall width W such that L is equal approximately to between about 0.95 and about 1.3 times W. The pad may include an enlarged end portion and a narrow end portion. The narrow end portion may include a width w such that L is equal approximately to between about 1.9 and about 3.0 times w, and W is equal approximately to between about 1.5 and about 2.5 times w.

Figure 6:
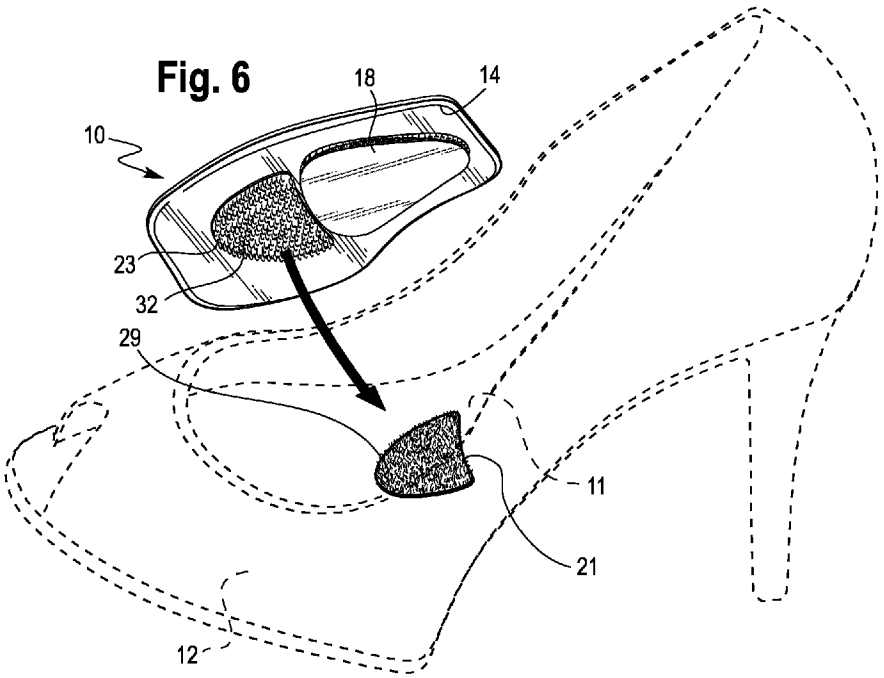
FIG. 6 is a view illustrating one part of the two-part fastener fixed to the underside of the pad of FIG. 2 and the other part of the two-part fastener fixed to the inner sole of a high heel foot wear.
Figure 7:
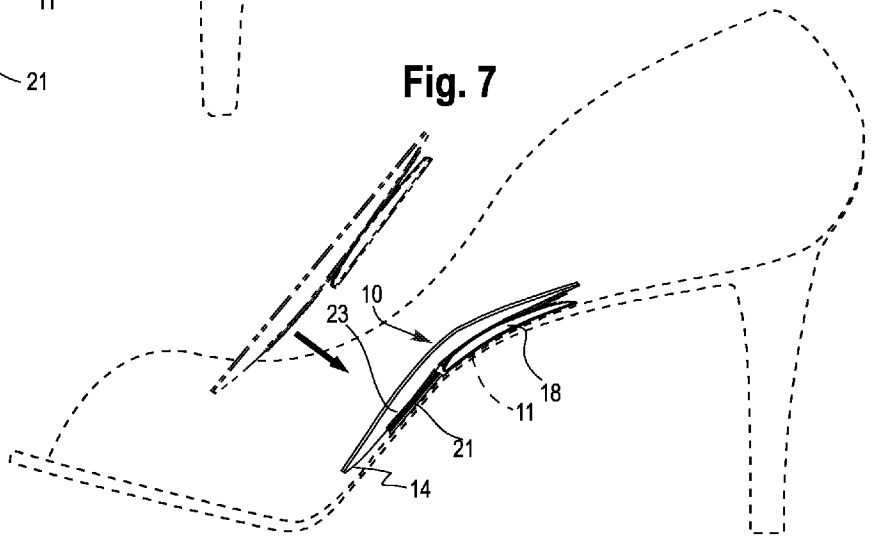
FIG. 7 illustrates the pad of FIG. 6 in the process of being attached by the two-part fastener to the high heel foot wear.
Figure 8:
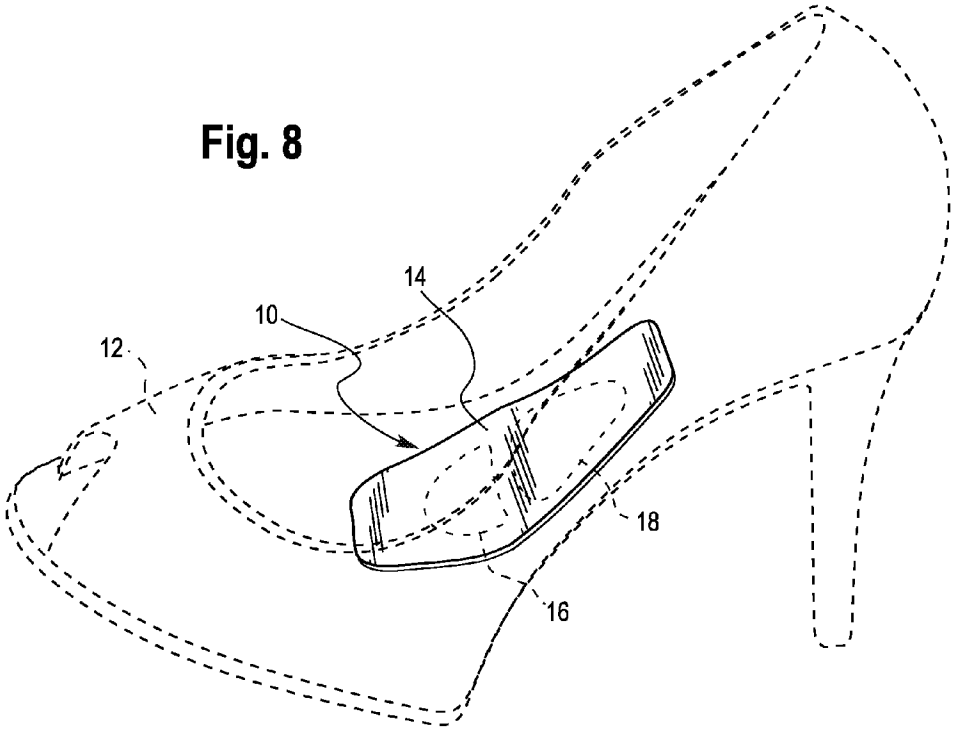
FIG. 8 illustrates the pad of FIGS. 6 and 7 in the process of being finally inserted into a position within the high heel foot wear.

Referring now to the drawings, and more particularly to FIGS. 1-5 thereof, there is shown a high heel foot wear pad 10 which is adapted to be used with foot wear such as the high heel foot wear such as a shoe 12 of FIGS. 6-8. The high heel foot wear pad 10 may include a soft pliable foot engageable sheet 14, which may be sized and shaped to fit into the high heel shoe 12 to help support the foot of the wearer. As shown in FIG. 1, the pad includes an overall length L and an overall width W such that L is equal approximately to between about 0.95 and about 1.30 times W, and more particularly between about 1.0 and about 1.20 times W, and most preferably about 1.16 times W. The pad may include an enlarged end portion and a narrow end portion. The narrow end portion may include an overall width w such that L is equal approximately to between about 1.9 and about 3.0 times w, and more particularly between about 2.0 and about 2.5 times w, and most preferably about 2.32 times w. Also, W is equal approximately to between about 1.5 and about 2.5 times w, and more particularly between about 1.8 and about 2.3 times w, and most particularly about 2.0 times w.

Referring now to the drawings, and more particularly to FIGS. 2-5 thereof, the pad 10 is illustrated prior to installing it in the shoe 12. The pad fastener 16 includes a protective cover 25 on an adhesive applied backside 26 of a first part 21 to cover over the adhesive on the backside of the first part 21 prior to installation. Upon removal of the protective cover 25, the first part 21 of the pad fastener 16 may be applied by pressing manually the backside 26 onto the inner sole 11 of the foot wear 12 as best seen in FIGS. 6 and 7.

As shown in FIGS. 6 and 7, the top side of the first part 21 of the pad fastener 16 may be provided with a fuzzy material 29 for engaging a hook material 32 on a second part 23 of the pad fastener 16 so that the two parts of the pad fastener 16 may move into engagement with one another to secure the pad 10 in place within the foot wear 12 on its inner sole 11 in a releasable manner. Thus, if the initial position of the pad 10 on the inner sole 11 does not feel entirely comfortable to the wearer, the wearer may then separate the two parts of the pad fastener 16 and reposition them together at a somewhat different location. This method may be repeated until the wearer determines that the pad 10 and its detachable arch support component 18 engage the foot of the wearer in a comfortable and supportive manner.

As shown in FIG. 8, the pad 10 is attached to the inner sole 11 of shoe 12. The shoe 12 is now ready for a wearer to wear.

Considering now the arch support component 18 in greater detail, the component 18 includes a flexible thin backing member 27 and, as best seen in HG. 3, a fuzzy material 29 for engaging the hook material 32 of a first part 22 of an arch support component fastener 17 attached to the sheet 14. The fuzzy material 29 may be employed in various thicknesses so that the user may be provided with two or more detachable arch support components for each pad where each arch support component has a different thickness to accommodate the foot of a particular wearer. A hook material 32 may be secured to the underside of the sheet 14 for engaging the fuzzy material 29 of the arch support component 18.

By utilizing the pad fastener 16, the pad 10 can be attached in a convenient manner to various positions on the inner sole 11 of the foot wear 12 for accommodating a particular foot of the wearer. Additionally, by providing extra detachable arch support components each having a different thickness, the desired engagement of the pad 10 to the user's foot may be readily accommodated.

The pad fastener 16 and the arch support component fastener 17 as well as the fuzzy material 29 and hook material 32 may be composed of suitable material such as Velcro® material, or other suitable removably connectable materials.

Figure 4:
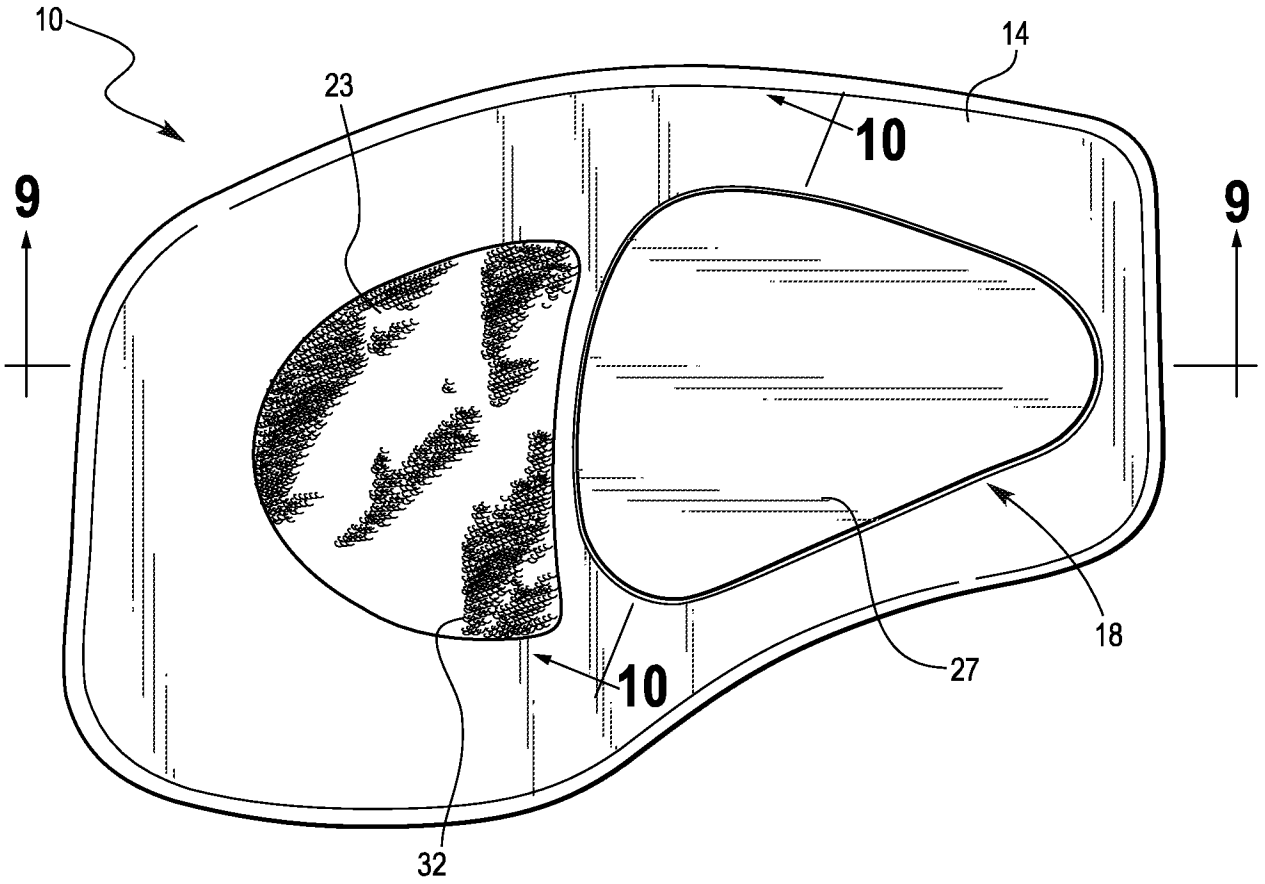
FIG. 4 is a view of the pad of FIG. 2, illustrating the arch support component releaseably secured in place and the protective cover sheet removed from the two-part fastener.
Figure 5:
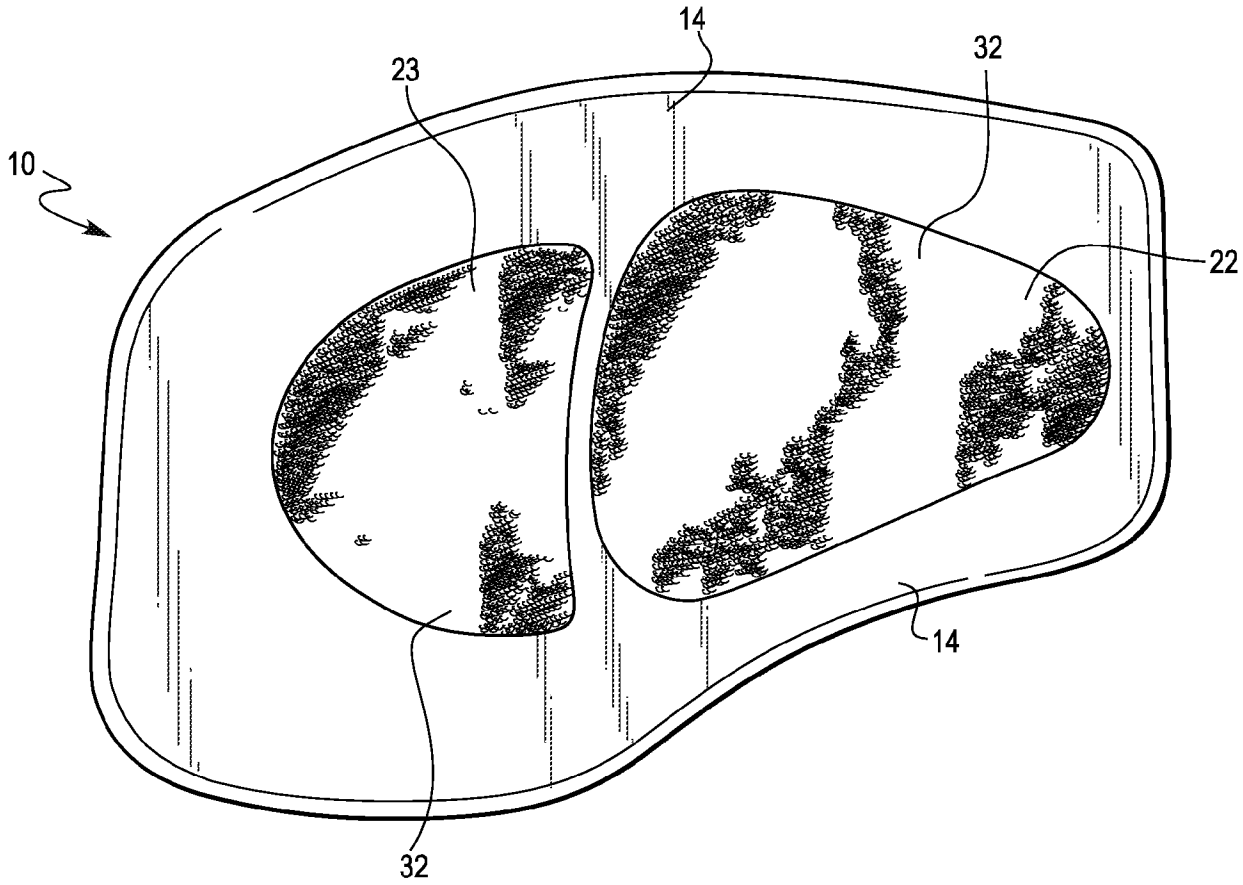
FIG. 5 is a view of the pad of FIG. 2, illustrating both the protective cover sheet and the arch support component removed.
Figure 9:
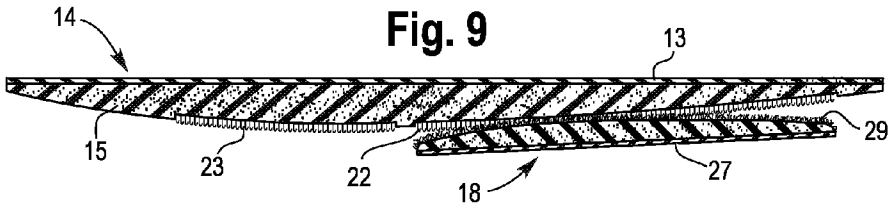
FIG. 9 is a sectional view of the pad and arch support component of FIG. 4, taken along lines 9-9 thereof and which provides light support for a wearer.
Figure 10:
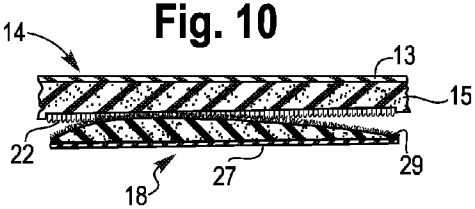
FIG. 10 is a sectional view of the pad and the arch support component of FIG. 4, taken along lines 10-10 thereof and which provides light support for a wearer.
Figure 11:
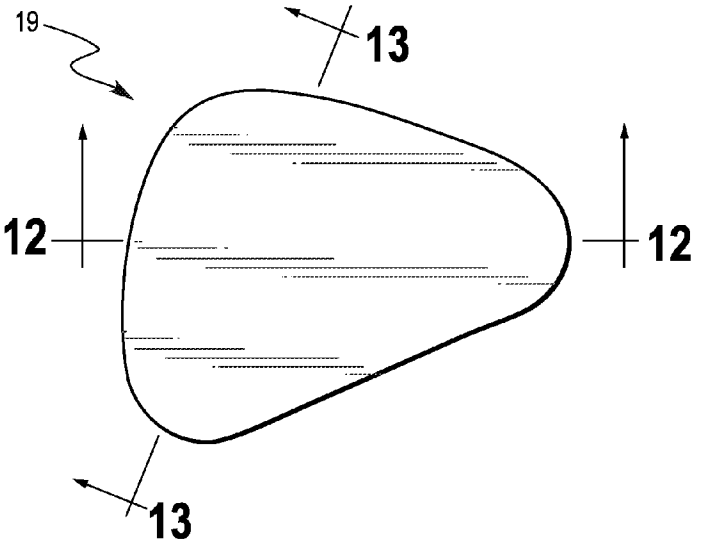
FIG. 11 is a bottom view of another arch support component for the pad of FIG. 4.
Figure 13:
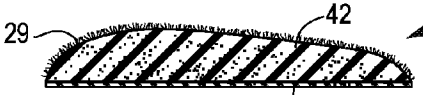
FIG. 13 is a sectional view of the arch support component of FIG. 4, taken along lines 13-13 thereof and which provides firm support for a wearer.
Figure 12:
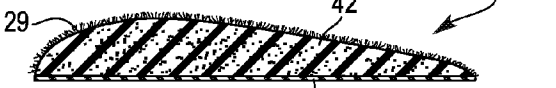
FIG. 12 is a sectional view of the arch support component of FIG. 4, taken along lines 12-12 thereof and which provides firm support for a wearer.

Referring now to FIGS. 9-13, a pair of arch support components 18 and 19 are shown that provides different amounts of arch support for the wearer. A light arch support 18 (as shown in FIGS. 4, 9 and 10) and a firm arch support 19 (as shown in FIGS. 11-13) may be provided, but it should be understood that a different number may also be provided. Each arch support component 18 and 19 may be generally in the shape of an isosceles triangle having three edges including a generally curvilinear short edge and two generally rectilinear side edges, with all sides being integrally connected. The thickness of each arch component 18 and 19 may determine the amount of support and flexibility. The light arch support 18 may include a thinner convex shape that provides a lower level of arch support and more flexibility. The firm arch support 19 may include a thicker convex shape that provides a higher level of arch support and lesser flexibility.

As shown in FIGS. 9 and 10, a sectional view of the arch support component 18 is attached to the sheet 14. The sheet 14 may include a poron backing layer 13 attached to the top of a cushion material tapered block 15. The second part 23 of the pad fastener 16 and the first part 22 of the arch support component fastener 17 may comprise the hook material 32 and are attached to the bottom of the cushion material tapered block 15. The arch support component 18 may include the flexible thin backing member 27 attached to the fuzzy material 29 for engaging the hook material 32 of the first part 22 of the arch support component fastener 17.

Shown in FIGS. 11-13 include a top and sectional views of the firm arch support component 19. The firm arch support component 19 may include a flexible thin backing member 44 attached to a fuzzy material 42 for engaging the hook material 32 of the first part 22 of the arch support component fastener 17.

Figure 14:
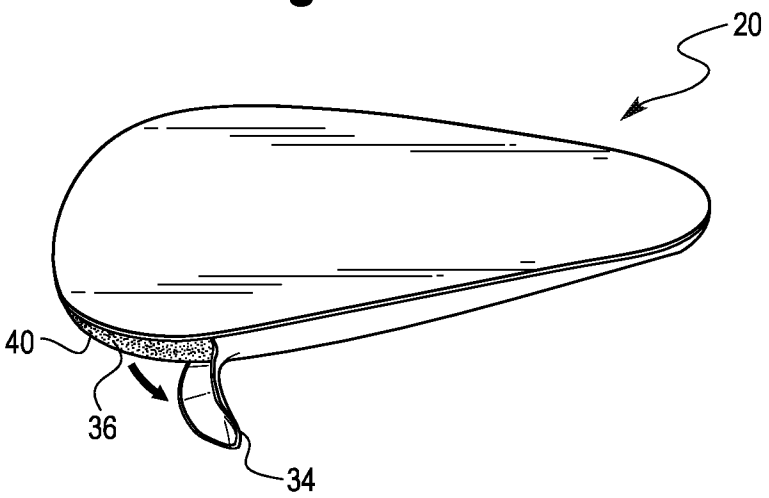
FIG. 14 is a bottom view of another pad having an arch support component illustrating the protective cover sheet partially removed.

Referring now to FIG. 14, another embodiment of pad 10 is shown including an arch support component 20, a fastener 36 and a protective cover 34. In the embodiment shown in HG. 14, after removal of the protective cover 34, the arch support component 20 can be attached with the fastener 36 to the arch engageable inner sole 11 of the shoe 12. As shown in FIG. 14, the fastener 36 may comprise an adhesive material 40 that affixes the arch support component 20 to the inner sole 11. In other embodiments, the fastener 36 may comprise a two-part fastener such as described above.

A method of attaching a pad to high heal foot wear may including the following steps. First, a pad is provided having an arch support component attached to the underside of a soft pliable foot engageable sheet. Second, one part of a two-part fastener is attached to an arch engageable inner sole of the high heel foot wear. Third, a second part of the two-part fastener may attach releaseably to the underside of the sheet for engaging releaseably the first part to fix releaseably the arch support component in a position to help support the arch of the wearer. And fourth, the second part of the fastener may be detached from the first part thereof to facilitate the repositioning of the arch support component to another position for more effectively enabling the arch support component to support the arch of the wearer.

While particular embodiments of the present invention have been disclosed, it is to be understood that various different modifications and combinations are possible and are contemplated within the true spirit and scope of the disclosed embodiments. There is no intention, therefore, of limitations to the exact disclosure herein presented.

What is claimed is:

1. A high heel foot wear pad for high heel foot wear having an arch engaging inner sole comprising:

a soft pliable foot engageable sheet having edges for fitting into the high heel foot wear to engage the arch engaging inner sole;

a first fastener on the underside of the sheet to detachably secure the sheet in place on the arch engaging inner sole of the high heel foot wear;

wherein the first fastener includes first and second parts, the first part for attachment to the inner sole and the second part for attachment to the sheet underside and for releasable attachment to the first part, whereby the positioning of the sheet to the inner sole may be adjusted; and an arch support component, detachably mounted to the underside of the sheet with a second fastener and spaced from the edges of the sheet to help support the foot of the wearer;

wherein the second fastener includes first and second parts, the first part for attachment to the arch support component and the second part for attachment to the sheet underside and for releasable attachment to the first part, whereby the positioning of the arch support component to the sheet may be adjusted;

wherein the pad includes a length L and a width W where L is equal approximately to between about 0.95 times and about 1.30 times W; and wherein the sheet includes an enlarged end portion and a narrow end portion, and wherein the arch support component is positioned between the second two-part fastener and the narrow end portion.

2. A high heel foot wear pad according to claim 1, wherein the first part is composed of a fuzzy material and the second part is composed of hook material.

3. A high heel foot wear pad according to claim 1, wherein the pad further includes a second alternative arch support component having a thickness different from the first arch support component and that is detachably mounted to the underside of the sheet and spaced away from the edges of the sheet.

4. A high heel foot wear pad according to claim 1, wherein the narrow end portion includes a width w where L is equal approximately to between about 1.9 and about 3.0 times w, and W is equal approximately to between about 1.5 and about 2.5 times w.

5. A high heel foot wear pad according to claim 1, wherein the arch support component is generally in the shape of an isosceles triangle having three edges including a generally curvilinear short edge integrally connected to a first rounded corner, the first rounded corner integrally connected to a first generally rectilinear side edge having a second rounded corner, the second rounded corner integrally connected to a second generally rectilinear side edge having a third rounded corner, and the third rounded corner integrally connected to the generally curvilinear short edge.

6. A method of making a pad for a high heel foot wear having an arch engaging inner sole comprising:

providing a soft pliable foot engageable sheet having edges for fitting into the high heel foot wear to engage the arch engaging inner sole;

attaching a first fastener to the underside of the soft pliable foot engageable sheet to detachably secure the sheet in place on the arch engaging inner sole of the foot wear; and attaching an arch support component on the underside of the sheet with a second fastener to help support the foot of the wearer;

wherein the first fastener includes first and second parts, the first part for attachment to the arch engaging inner sole and the second part for attachment to the sheet underside and for releasable attachment to the first part, whereby the positioning of the sheet to the arch engaging inner sole may be adjusted;

wherein the second fastener includes first and second parts, the first part for attachment to the arch support component and the second part for attachment to the sheet underside and for releasable attachment to the first part, whereby the positioning of the arch support component to the sheet may be adjusted; and wherein the arch support component is detachably mounted to the underside of the sheet and spaced away from the edges of the sheet;

wherein the pad includes a length L and a width W where L is equal approximately to between about 0.95 times and about 1.30 times W; and wherein the pad includes an enlarged end portion and a narrow end portion, and wherein the arch support component is positioned between the second two-part fastener and the narrow end portion.

7. A method of making a pad for a high heel foot wear pad according to claim 6, wherein the pad further includes:

a length L and a width W where L is equal approximately to between about 0.95 times and about 1.30 times W;

wherein the narrow end portion includes a width w where L is equal approximately to between about 1.9 and about 3.0 times w, and W is equal approximately to between about 1.5 and about 2.5 times w.

8. A high heel foot wear pad according to claim 6, wherein the arch support component is generally in the shape of an isosceles triangle having three edges including a generally curvilinear short edge integrally connected to a first rounded corner, the first rounded corner integrally connected to a first generally rectilinear side edge having a second rounded corner, the second rounded corner integrally connected to a second generally rectilinear side edge having a third rounded corner, and the third rounded corner integrally connected to the generally curvilinear short edge.

9. A method of attaching a sheet to a high heal foot wear having a sloping arch engageable portion of an inner sole comprising:

providing a soft pliable foot engageable sheet having edges and having a first two-part fastener and a second two-part fastener on the underside thereof;

attaching fixedly a first part of the first two-part fastener to the sheet and a second part of the first two-part fastener to an arch support component;

attaching releaseably the second part of the first two-part fastener to the first part releaseably to position adjustably the arch support component along the underside of the sheet and spaced from the edges of the sheet so that the arch of the wearer is helped being supported; and attaching fixedly a first part of the second two-part fastener to the pad and a second part of the second two-part fastener to the sloping arch engageable portion of the inner sole of the high heel foot wear;

attaching releaseably the second part of the second two-part fastener to the first part releaseably to position adjustably the sheet along the sloping arch engageable portion of the inner sole so that the arch of the wearer is helped being supported; and detaching the first two-part fastener and the second two-part fastener to facilitate the repositioning of the sheet and the arch support component to another position for more effectively enabling the arch support component to help support the arch of the wearer;

wherein the sheet includes a length L and a width W where L is equal approximately to between about 0.95 times and about 1.30 times W; and wherein the sheet includes an enlarged end portion and a narrow end portion, and wherein the arch support component is positioned between the second two-part fastener and the narrow end portion.

10. A method of attaching a pad to a high heel foot wear pad according to claim 9, wherein the pad further includes:

a length L and a width W where L is equal approximately to between about 0.95 times and about 1.30 times W;

wherein the narrow end portion includes a width w where L is equal approximately to between about 1.9 and about 3.0 times w, and W is equal approximately to between about 1.5 and about 2.5 times w.

* * * * *